US011302468B2

(12) United States Patent
Kreuzberg et al.

(10) Patent No.: US 11,302,468 B2
(45) Date of Patent: Apr. 12, 2022

(54) ELECTROMAGNET AND METHOD TO PRODUCE THE ELECTROMAGNET

(71) Applicant: Thomas Magnete GmbH, Herdorf (DE)

(72) Inventors: Edwin Kreuzberg, Daaden (DE); Thomas Rolland, Gebhardshain (DE); Olaf Ohligschlager, Grünebach (DE); Thomas Baum, Hennef (DE)

(73) Assignee: Thomas Magnete GmbH, Herdorf (DE)

( * ) Notice: Subject to any disclaimer, the term of this patent is extended or adjusted under 35 U.S.C. 154(b) by 271 days.

(21) Appl. No.: 16/395,655

(22) Filed: Apr. 26, 2019

(65) Prior Publication Data

US 2019/0333668 A1 Oct. 31, 2019

(30) Foreign Application Priority Data

Apr. 28, 2018 (DE) ..... 10 2018 003 509.4

(51) Int. Cl.
*H01F 7/08* (2006.01)
*H01F 3/06* (2006.01)
*H01F 41/04* (2006.01)

(52) U.S. Cl.
CPC ..... *H01F 7/081* (2013.01); *H01F 3/06* (2013.01); *H01F 41/04* (2013.01)

(58) Field of Classification Search
CPC ..... H01F 7/081; H01F 2007/083
See application file for complete search history.

(56) References Cited

U.S. PATENT DOCUMENTS 1,888,322 A 11/1932 Adolph
2,587,356 A 2/1952 McPherson
2,749,403 A * 6/1956 Horman ..... H01H 50/20 335/126
5,351,527 A 10/1994 Blackbum et al.
6,886,597 B2 5/2005 Dragoni et al.
7,290,564 B2 11/2007 Takahashi et al.
(Continued)

FOREIGN PATENT DOCUMENTS

DE 7136453 U 12/1971
DE 3131650 C2 2/1985
(Continued)

OTHER PUBLICATIONS

U.S. Appl. No. 16/395,670, 2019-0331109, filed Apr. 26, 2019, Mueller, et al.
(Continued)

*Primary Examiner* — Ramon M Barrera
(74) *Attorney, Agent, or Firm* — Harness, Dickey & Pierce, P.L.C.

(57) ABSTRACT

An electromagnet and method for producing an electromagnet. The electromagnet includes a sheet metal casing encompassing a magnetic coil at its end face on a magnetic pole side and extends into an interior of the magnetic coil and forms, in this case, a magnetic pole which interacts with a magnet keeper. The electromagnet enables actuation of a valve, a coupling or a reciprocating pump. The structure is achieved with as few cutting processes as possible to be used for generating the individual parts and as small a number as possible of individual parts is to be used per electromagnet.

10 Claims, 2 Drawing Sheets

(56) References Cited

U.S. PATENT DOCUMENTS

| | | | |
|---|---|---|---|
| 2005/0047923 | A1 | 3/2005 | Li et al. |
| 2005/0056081 | A1 | 3/2005 | Gocho |
| 2008/0014103 | A1 | 1/2008 | Cooke |
| 2008/0109185 | A1 | 5/2008 | Cheung et al. |
| 2008/0127919 | A1 | 6/2008 | Gale et al. |
| 2016/0363510 | A1 | 12/2016 | Kanack et al. |

FOREIGN PATENT DOCUMENTS

| | | | |
|---|---|---|---|
| DE | 4437670 | C1 | 4/1996 |
| DE | 10132959 | A1 | 1/2003 |
| DE | 602004008596 | T2 | 12/2007 |
| DE | 102007001141 | A1 | 7/2008 |
| DE | 102012105028 | A1 | 12/2012 |
| DE | 102013015453 | A1 | 7/2014 |
| DE | 102013202632 | A1 | 8/2014 |
| DE | 102013013252 | A1 | 2/2015 |
| DE | 102014013665 | A1 | 3/2016 |
| DE | 102015011936 | A1 | 3/2017 |
| DE | 102016002348 | A1 | 8/2017 |
| EP | 061699 | A1 | 10/1982 |
| FR | 2666853 | A1 | 3/1992 |
| WO | 02086918 | A1 | 10/2002 |

OTHER PUBLICATIONS

U.S. Appl. No. 16/395,679, 2019-0331107, filed Apr. 26, 2019, Baum, et al.
U.S. Appl. No. 16/395,711, 2019-0331241, filed Apr. 26, 2019, Kreuzberg, et al.

* cited by examiner

Fig. 2
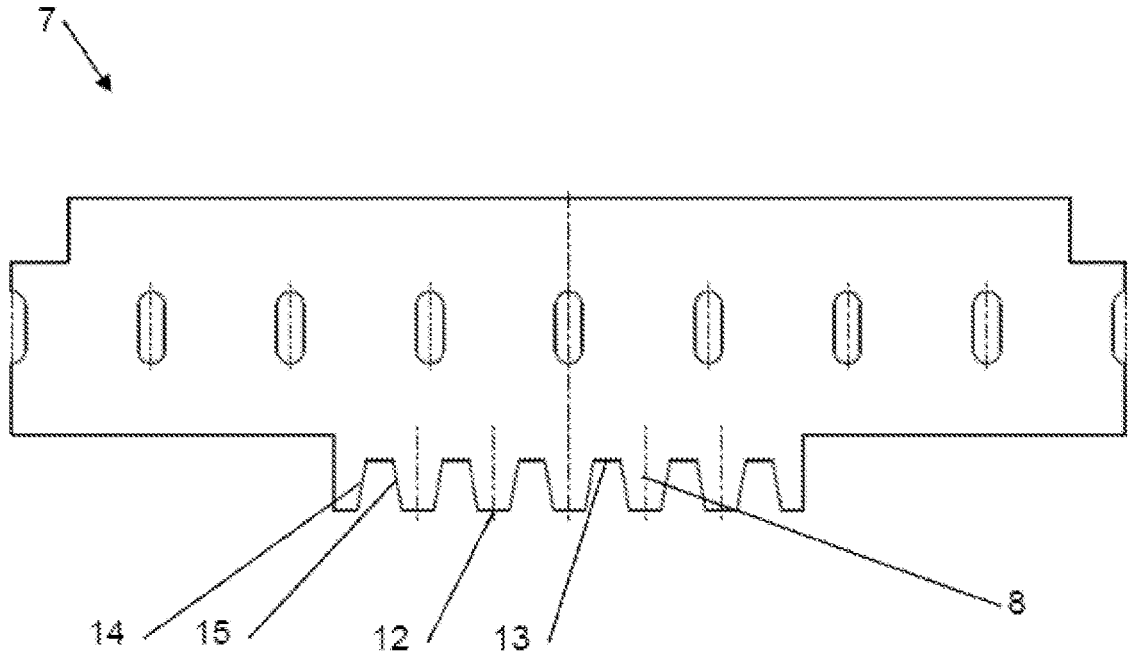
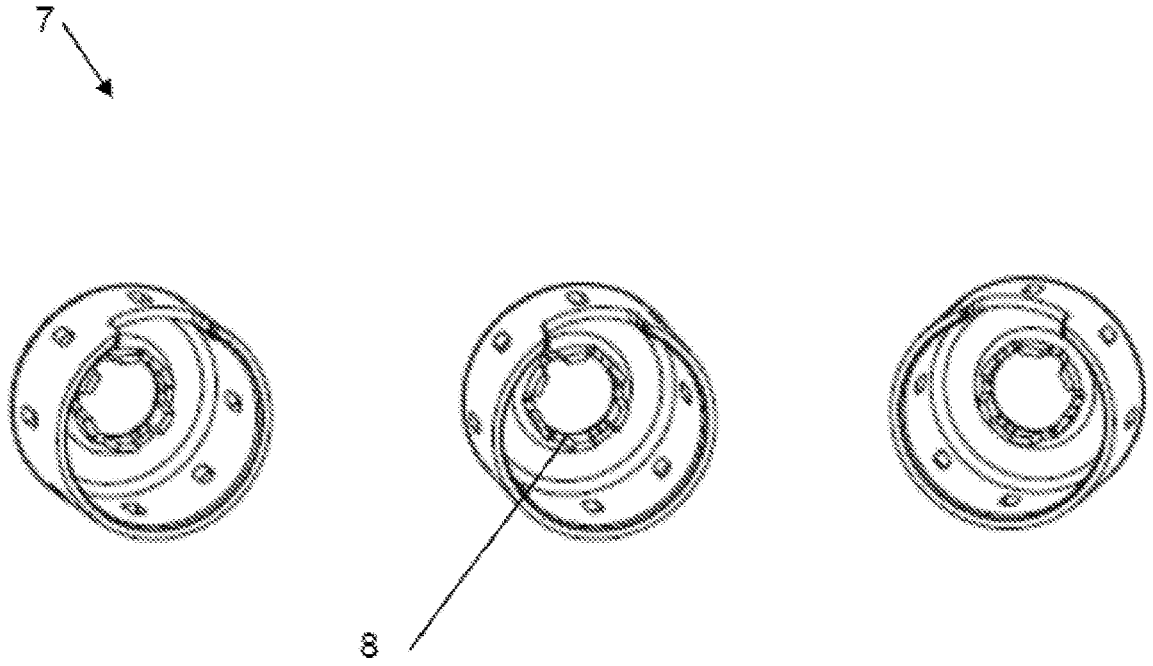
Fig. 3

ELECTROMAGNET AND METHOD TO PRODUCE THE ELECTROMAGNET

CROSS-REFERENCE TO RELATED APPLICATIONS

This application claims the benefit and priority of German Application No. 10 2018 003 509.4 filed on Apr. 28, 2018. The entire disclosure of the above application is incorporated herein by reference.

FIELD

The present disclosure relates to an electromagnet as well as to a method for producing the electromagnet.

BACKGROUND

This section provides background information related to the present disclosure which is not necessarily prior art.

Electromagnets for actuating valves, couplings or reciprocal pumps in a switching or proportionally acting manner have been disclosed and are widespread.

Such an electromagnet is shown, for example, in document DE 10 2011 011 362 B4.

Production is expensive in particular when high precision of the force generated and low hysteresis are required in large quantities.

The iron circuit of the electromagnet is usually assembled from a plurality of components, namely from a yoke, a yoke disc, a casing produced from sheet iron and a cone as magnetic pole. Each transition of the magnetic flux from one component to another generates a magnetic resistance which, as such, is disadvantageous but is also variously sized in a tolerance-related manner from electromagnet to electromagnet and consequently increases the total spread of the characteristic curves.

SUMMARY

This section provides a general summary of the disclosure, and is not a comprehensive disclosure of its full scope or all of its features.

When producing in large quantities, it is desirable that as few cutting processes as possible are used for generating the individual parts and that as small as possible a number of individual parts is used per electromagnet.

As few individual parts as possible are to be used, in particular, in the iron circuit of the electromagnet because each transition of the magnetic flux from one part to another part generates an unwanted magnetic resistance.

The electromagnet according to the disclosure includes at least one magnetic coil, one magnet keeper, one yoke and one iron backplate. The iron backplate consists, in this case, of at least one sheet metal casing which encompasses the magnetic coil at least at its circumference. The sheet metal casing encompasses the magnetic coil also at its end face on the magnetic pole side and extends into the interior of the magnetic coil and forms, in this case, a magnetic pole which interacts with the magnet keeper.

The sheet metal casing in a first embodiment is produced from a circular blank as a result of a stamping and forming process. Mechanical re-working can be avoided if the forming processes have sufficient precision.

In a second realization, the sheet metal casing is produced from granular iron as a result of a sintering process. Sufficient precision is also able to be achieved in the case of said process.

In a third realization, the sheet metal casing is produced from solid material as a result of a machining process, which is suited to the production of samples in small quantities.

In a fourth realization, the sheet metal casing is produced as a result of an MIM process (metal injection moulding). In this case, all forming elements in the injection mould are reproduced with sufficient precision so that mechanical reworking is not necessary.

In a fifth realization, the sheet metal casing is produced as a result of a combination of at least two processes, selected from the group (stamping and forming, sintering, machining and MIM). In the case of said combination, a higher level of precision can be achieved than in the case of one of the mould-bound methods on its own.

The magnetic pole comprises a form which deviates considerably from a cylindrical form by zones which protrude axially beyond the circumference by more than 0.2 mm, preferably by more than 1 mm, further preferably by more than 2 mm, and axially recessed zones alternating. Said forming elements replace the cone which occurs in other electromagnets and forms the force-stroke curve of the electromagnet.

Further, the protruding zones are connected to the recessed zones of the magnetic pole by first flanks and by second flanks, wherein the absolute angles of the first flanks to the centre line of the electromagnet differ from the absolute angles of the second flanks to the centre line by at least 3°, preferably by more than 5°, further preferably by more than 10°. As a result, a rotational movement of the keeper is able to be generated when the keeper carries out a stroke.

For producing the electromagnet according to the disclosure corresponding to the first realization, which includes at least one magnetic coil, one magnet keeper and one iron backplate, the following method is applied:

- the metal sheet is produced as a result of forming from a circular blank which is perforated and/or cut in its centre as a result of stamping,
- the centre of the circular blank is inverted in such a manner that it extends into the interior of the sheet metal casing, wherein the form of the perforation of the centre produces protruding zones and recessed zones of a magnetic pole which is generated by the inverting process.

The electromagnet according to the disclosure is used for actuating a valve, a coupling or a reciprocating pump.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 2 shows a developed view of the sheet metal casing cut open after the forming process.

FIG. 3 shows various perspective views of the sheet metal casing.

Corresponding reference numerals indicate corresponding parts throughout the several views of the drawings.

DETAILED DESCRIPTION

Figure 1:
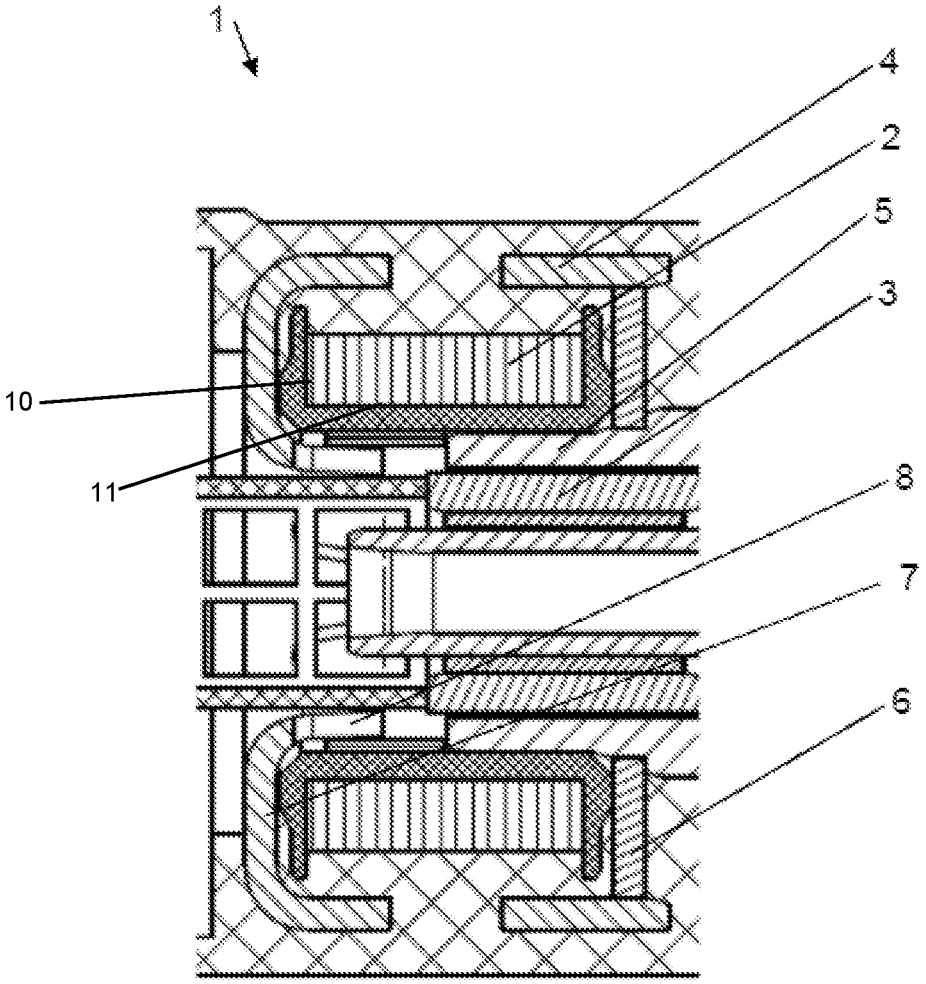
FIG. 1 shows a cross section of the electromagnet, the electromagnet being part of a larger instrument.

Example embodiments will now be described more fully with reference to the accompanying drawings.

An electromagnet (1) includes at least one magnetic coil (2), one yoke (5), one magnet keeper (3) and one iron backplate (4). The exemplary embodiment shows in addition a yoke disc (6) which can also be part of the yoke (5) or part of the iron backplate (4).

The iron backplate (4) consists here of a sheet metal casing (7) which encompasses the magnetic coil (2) at least at its circumference. The sheet metal casing (7) encompasses the magnetic coil (2) also at its end face (10) on the magnetic pole side and extends into the interior (11) of the magnetic coil (2). In this case, it forms a magnetic pole (8) which interacts with the movable magnet keeper (3).

Corresponding to the developed view shown in FIG. 2 and to the perspective views shown in FIG. 3, the magnetic pole (8) comprises a form which deviates considerably from a cylindrical form by zones (12), which protrude axially beyond the circumference by more than 1 mm, and axially recessed zones (13) alternating. In this case, the protruding zones (12) are connected to the recessed zones (13) of the magnetic pole (8) by means of first flanks (14) and by means of second flanks (15).

LIST OF REFERENCES

1. Electromagnet
2. Magnetic coil
3. Magnet keeper
4. Iron backplate
5. Yoke
6. Yoke disc
7. Sheet metal casing
8. Magnetic pole
10. End face
11. Interior
12. Protruding zone
13. Recessed zone
14. First flank
15. Second flank The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An electromagnet, comprising:
at least one magnetic coil;
a magnet keeper;
a yoke; and
an iron backplate;
wherein the iron backplate includes a sheet metal casing which encompasses the magnetic coil at least at its circumference;
wherein the sheet metal casing encompasses the magnetic coil also at its end face on a magnetic pole side and extends into an interior of the magnetic coil and forms, in this case, a magnetic pole which interacts with the magnet keeper:
wherein the magnetic pole is formed by a plurality of protruding zones and recessed zoned extending beyond an inner circumference of the sheet metal casing.

2. The electromagnet according to claim 1, wherein the sheet metal casing is produced from a circular blank as a result of a stamping and forming process.

3. The electromagnet according to claim 1, wherein the sheet metal casing is produced from a circular blank as a result of a stamping and forming process.

4. The electromagnet according to claim 1, wherein the sheet metal casing is produced from solid material as a result of a machining process.

5. The electromagnet according to claim 1, wherein the sheet metal casing is produced as a result of a MIM (metal injection moulding) process.

6. The electromagnet according to claim 1, wherein the sheet metal casing is produced as a result of a combination of at least two processes, selected from the group stamping and forming, sintering, machining and MIM.

7. An electromagnet, comprising:
at least one magnetic coil;
a magnet keeper;
a yoke; and
an iron backplate;
wherein the iron backplate includes a sheet metal casing which encompasses the magnetic coil at least at its circumference;
wherein the sheet metal casing encompasses the magnetic coil also at its end face on a magnetic pole side and extends into an interior of the magnetic coil and forms, in this case, a magnetic pole which interacts with the magnet keeper;
wherein the magnetic pole is formed by a plurality of protruding zones and recessed zoned extending beyond an inner circumference of the sheet metal casing:
wherein the magnetic pole comprises a form which deviates considerably from a cylindrical form by zones which protrude axially beyond the circumference by more than 0.2 mm, preferably by more than 1 mm, further preferably by more than 2 mm, and axially recessed zones alternating.

8. The electromagnet according to claim 7, wherein the protruding zones are connected to the recessed zones of the magnetic pole by first flanks and by second flanks, wherein the absolute angles of the first flanks to the centre line of the electromagnet differ from the absolute angles of the second flanks to the centre line by at least 3°, preferably by more than 5°, further preferably by more than 10°.

9. A method for producing an electromagnet which includes at least one magnetic coil, a magnet keeper and an iron backplate, wherein the iron backplate includes at least of one yoke and one sheet metal casing which encompasses the magnetic coil at least at its circumference, the method comprising:
the sheet metal casing is produced as a result of forming from a circular blank which is perforated and/or cut in its centre as a result of stamping;
the centre of the circular blank is inverted in such a manner that it extends into an interior of the sheet metal casing; and
the form of the perforation of the centre produces protruding zones and recessed zones of a magnetic pole which is generated by an inverting process;

wherein the magnetic pole comprises a form which deviates considerably from a cylindrical form by zones which protrude axially beyond the circumference by more than 0.2 mm, preferably by more than 1 mm, further preferably by more than 2 mm, and axially recessed zones alternating.

10. An electromagnet, comprising:

at least one magnetic coil;

a magnetic keeper; a yoke; and a sheet metal casing having an annular end face, an outer upturn wall, and an inner upturned wall;

wherein the sheet metal casing encompasses the magnetic coil at least at a circumference and an end face of the magnetic coil;

wherein the inner upturned wall of the sheet metal casing extends into an interior of the magnetic coil to form a magnetic pole that interacts with the magnetic keeper;

wherein the inner upturned wall includes at least one axially extending protrusion that extends beyond an inner circumference of the inner upturned wall to form the magnetic pole.

* * * * *